United States Patent [19]

Ishikawa

[11] Patent Number: 4,491,382

[45] Date of Patent: Jan. 1, 1985

[54] RESILIENT CONTACT MEMBER OF JACK FOR USE IN CONJUNCTION WITH PIN PLUG

[75] Inventor: Kazuhiro Ishikawa, Tomioka, Japan

[73] Assignee: Iizuka Electric Industry Company Ltd., Tomioka, Japan

[21] Appl. No.: 579,803

[22] Filed: Feb. 17, 1984

Related U.S. Application Data

[63] Continuation of Ser. No. 389,318, Jun. 17, 1982, abandoned, which is a continuation of Ser. No. 127,786, Mar. 5, 1980, abandoned.

[30] Foreign Application Priority Data

Oct. 22, 1979 [JP] Japan ..... 54-146095
Oct. 22, 1979 [JP] Japan ..... 54-146096
Oct. 22, 1979 [JP] Japan ..... 54-146097

[51] Int. Cl.[3] ..... H01R 13/16
[52] U.S. Cl. ..... 339/259 R
[58] Field of Search ..... 339/176 R, 176 M, 176 MP, 339/252 R, 252 F, 252 P, 258 R, 258 F, 258 P, 259

[56] References Cited

U.S. PATENT DOCUMENTS 1,231,417 6/1917 Nero ..... 339/259 R
3,732,531 5/1973 Bouley ..... 339/258 P
3,893,745 7/1975 Codrino ..... 339/258 R
4,068,915 1/1978 Evans ..... 339/176 MP
4,266,845 5/1981 Ishikawa ..... 339/258 R

FOREIGN PATENT DOCUMENTS 608333 9/1960 Italy ..... 339/176 MP

*Primary Examiner*—Joseph H. McGlynn
*Attorney, Agent, or Firm*—Lawrence I. Field

[57] ABSTRACT

A resilient contact member to be installed in a jack for use in conjunction with a pin-plug comprising a fixed leg portion to be fixed to an inner wall of a housing of the jack, a movable leg portion having a portion which is to be engaged with a pin portion of the pin-plug inserted into the jack to make an electrical connection between the jack and pin-plug, a substantially U-shaped portion for connecting the fixed and movable leg portions to each other at their one ends, said fixed and movable leg portions extending in parallel with each other. The fixed and movable leg portions and U-shaped portion are all formed integrally with each other by punching a thin metal plate. The contact member further comprises a reinforcing member which engaging with the movable leg portion. The movable leg portion can be moved toward the fixed leg portion in a resilient manner against the resilient force of the movable leg portion and the reinforcing member.

4 Claims, 16 Drawing Figures

RESILIENT CONTACT MEMBER OF JACK FOR USE IN CONJUNCTION WITH PIN PLUG

This application is a continuation of application Ser. No. 389,318, filed June 17, 1982, abandoned, which was a continuation of Ser. No. 127,786 filed Mar. 5, 1980, abandoned.

BACKGROUND OF THE INVENTION

The present invention relates generally to an electrical jack for use in conjunction with a pin-plug, and more particularly to a resilient contact member which engages resiliently with a pin portion of the pin-plug inserted into the jack.

There have been proposed various kinds of the jack. FIG. 1 is a cross section showing an embodiment of the known jack. A jack 1 comprises a resilient contact member 2 which is secured to an inner wall of a housing 3. The contact member 2 is formed by bending a metal strip of a relatively large width into a substantially U-shaped form. The contact member 2 comprises a fixed leg portion 8 and a movable leg portion 10 connected to the leg portion 8 by means of a U-shaped bent portion 6. When a pin-plug 4 is inserted into the jack 1, the movable leg portion 10 is displaced from a position illustrated in FIG. 1 by a chain line due to an engagement of the movable leg portion 10 with a pin portion 5 of the plug 4. Each time the pin-plug 4 is inserted into and pulled out of the jack 1 the bent portion of the contact member 2 is deformed and thus is fatigued. Therefore a resiliency or elasticity of the contact member 2 becomes gradually decreased. In an extreme case the bent portion 6 might be deformed beyond its elastic limit and could not return to its original position. In this manner a contact pressure of the contact member 2 with respect to the pin portion 5 becomes small and thus an electrical property of the pin-plug and jack connection is deteriorated to a great extent.

In order to avoid the above mentioned drawback of the known jack there have been devised several jacks. FIG. 2A shows an embodiment of such a jack. In this jack 1 a projection 7 is formed on the inner wall of a housing 3 and a fixed leg portion 8 of contact member 2 is provided with a hole 9 as illustrated in FIG. 2B. As shown in FIG. 2A the contact member 2 is secured to the housing 3, while the projection 7 is inserted into the hole 9. The projection 7 has such a length that it can limit the displacement of the movable leg portion 10 of the contact member 2.

FIG. 3 shows another embodiment of the known contact member. In this embodiment a part of a fixed leg potion 8 of a contact member 2 is cut and a projection 11 is formed by raising the cut lug. In the embodiment the projection 11 serves to limit excessive displacement of the contact member 2.

The contact members illustrated in FIGS. 2 and 3 can overcome the disadvantage of the contact member shown in FIG. 1 and the movable leg portion 10 can be effectively prevented from being deformed beyond its elastic limit. However it is rather difficult to manufacture such contact members. It is apparent that the manufacture of such contact members requires at least one additional step. Particularly in case of a jack of small size the contact member could not be formed from a relatively wide metal strip, but has to be made of a thin metal strip such as a metal wire. In this case the above mentioned reinforcing means could not be applied at all.

The inventor has proposed in a copending U.S. patent application Ser. No. 71,163 filed on Aug. 30, 1979 an improved contact member for use in a jack. FIG. 4 shows an embodiment of such an improved contact member.

The comtact member 20 comprises a fixed leg portion 21 for securing the contact member to a housing of the jack; a movable leg portion 22 extending substantially in parallel with the fixed leg portion; a substantially U-shaped portion 23 for coupling the fixed and movable leg portions with each other at their one ends; and a projection 21*a* formed integrally with the fixed leg portion 21 and extending toward the movable leg portion 22, the projection 21*a* having such a length that a displacement of the movable leg portion 22 toward the fixed leg portion 21 can be limited by an engagement of the projection 22 with the leg portion 22, whereby said fixed leg portion, movable leg portion U-shaped portion and projection are all integrally formed by punching a metal plate. According to such a contact member the projection can effectively limit the displacement of the movable leg portion over the elastic limit and further the contact member can be simply formed by punching.

However after various tests it has been found that in the resilient contact member once the movable leg portion is made in contact with the projection, the movable leg portion could not further move toward the fixed leg portion 21. Therefore if a great force is applied to the movable leg portion by the pin, the jack and/or the pin might be damaged.

SUMMARY OF THE INVENTION

The present invention has for its object to provide a novel and useful resilient contact member for use in a jack, which contact member can avoid the avove mentioned drawback of the known contact members and can limit effectively an excessive displacement of a movable leg portion in a very simple manner without any additional manufacturing step.

It is another object of the invention to provide a contact member which can be advantageously installed in a jack of a small size.

According to the invention a contact member of a jack for use in conjunction with a pin-plug comprises a fixed leg portion for securing the contact member to a housing of the jack; a movable leg portion extending substantially in parallel with the fixed leg portion; a substantially U-shaped portion for coupling the fixed and movable leg portions with each other at their one ends, the fixed, movable and U-shaped portion being integrally formed by punching a metal plate; and a reinforcing member for engaging with the movable leg portion so as to allow a displacement of the movable leg portion in a resilient manner toward the fixed leg portion.

DESCRIPTION OF THE PREFERRED EMBODIMENTS

Figure 1:
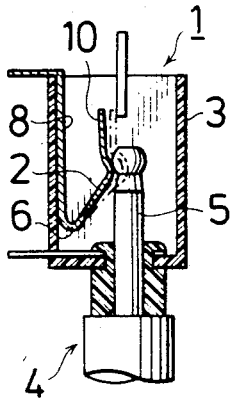
FIG. 1 is a cross section showing a connection of a pin-plug and a jack having a known contact member.
Figure 2A:
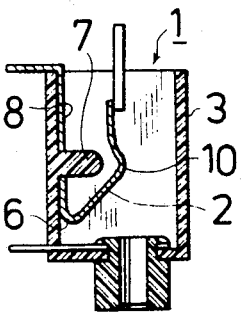
FIG. 2A is a cross section of a known jack and FIG. 2B is a perspective view illustrating a contact member of FIG. 2A
Figure 2B:
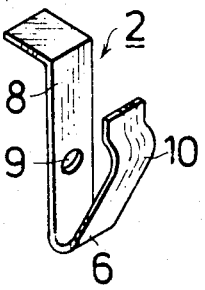
Figure 3:
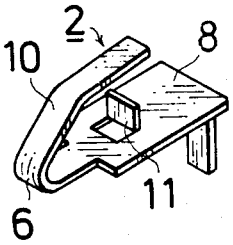
FIG. 3 is a perspective view showing another embodiment of a known contact member having means for limiting an excessive displacement of a movable leg portion.
Figure 4:
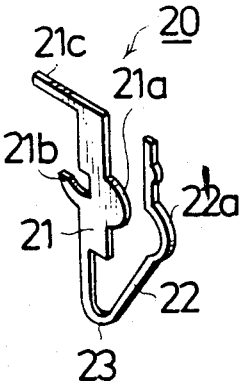
FIG. 4 is a perspective view showing a contact member having a projection for limiting the displacement of a movable leg portion beyond its elastic limit.
Figure 5A:
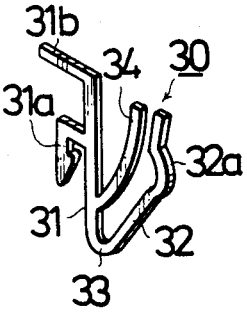
FIGS. 5A and 5B are perspective and plan views, respectively showing an embodiment of a contact member according to the invention.
Figure 5B:
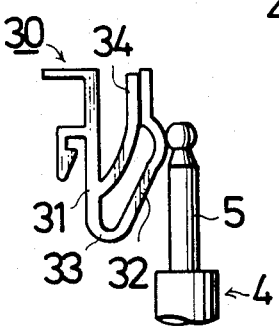

FIGS. 5A and 5B show a first embodiment of a resilient contact member of a jack according to the present invention. The contact member of the invention can be easily manufactured by punching a thin metal plate having a thickness of, for example, 0.5 mm by means of a pressing machine. FIG. 5A shows the contact member 30 in a free condition, i.e. in such a condition that it does not engage with a pin-plug. The contact member 30 comprises a fixed leg portion 31, a movable leg portion 32 and a U-shaped portion 33 for coupling the leg portions 31 and 32 with each other. The movable leg portion 32 has formed therein a semicircularly bent portion 32*a* which is resiliently engaged with a top of a pin portion 5 of a pin-plug 4 shown in FIG. 1. The fixed leg portion 31 has formed integrally therewith a small projection 31*a* for securing the contact member 30 to a housing of a jack and a terminal portion 31*b* for connecting a lead wire to the contact member 30.

The contact member 30 has further formed integrally therewith a curved projection 34 which extends in a space between the fixed leg portion 31 and the movable leg portion 32.

When the pin portion 5 of pin-plug 4 is inserted into the jack in which the contact member 30 has been installed the movable leg portion 32 is moved toward the fixed leg portion 31 and is engaged with the projection 34 as illustrated in FIG. 5B. Then the movable leg portion 32 moves together with the projection in a resilient manner toward the fixed leg portion 31 due to the resilience of the movable leg portion and the projection 34. Therefore the movable leg portion 32 could not be bent beyond its elastic limit, and thus the U-shaped portion 33 does scarecely wear and is not deformed beyond its elastic limit. Further the movable leg portion 32 is urged against the pin portion 5 with the great spring force produced by the projection 34 as well as the movable leg portion 32 and thus the pin portion 5 is hardly fallen off the jack.

Figure 6:
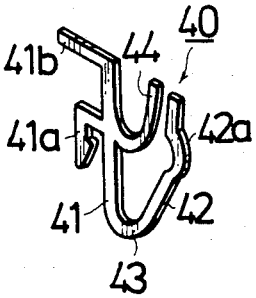
FIGS. 6, 7 and 8 are perspective views illustrating three embodiments of a contact member having a reinforcing member formed integrally according to the invention.

FIG. 6 is a perspective view illustrating another embodiment of the resilient contact member according to the invention. A contact member 40 of this embodiment is similar to the previous embodiment shown in FIGS. 5A and 5B. The contact member 40 comprises a fixed leg portion 41 having a projection 41*a* and a terminal portion 41*b*, a movable leg portion 42 having a semicircularly bent portion 42*a*, and a U-shaped portion 43. In this embodiment the fixed leg portion 41 has formed integrally therewith a reinforcing projection 44 extending between the fixed and movable leg portions substantially in parallel therewith. The projection 44 serves to allow the resilient displacement of the movable leg portion 42 toward the fixed leg portion 41.

Figure 7:
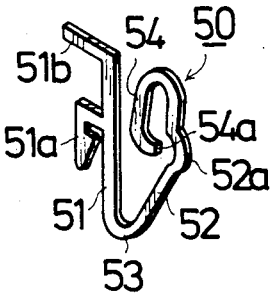

FIG. 7 shows another embodiment of the contact member according to the invention. A contact member 50 of this embodiment comprises a fixed leg portion 51 with projections 51*a* and 51*b*, a movable leg portion 52 and a U-shaped portion 53. In this embodiment a reinforcing member 54 is formed by extending the movable leg portion 52 and bending the extension into a space between the fixed and movable leg portions. The reinforcing member 54 extends substantially in parallel with the leg portions 51 and 52. A free end 54*a* of the reinforcing member 54 is further bent toward a semicircular portion 52*a* of the movable leg portion 52. At first the reinforcing portion 54 is urged against the fixed leg portion 51 and the movable leg portion 52 is allowed to move toward the fixed leg portion. After the free end 54*a* has been made in contact with the portion 52*a* the movable leg portion 52 cannot move toward the fixed leg portion any more.

Figure 8:
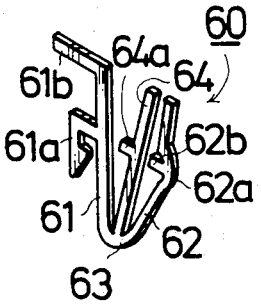

FIG. 8 illustrates another embodiment of the contact member of the invention. A contact member 60 comprises a fixed leg portion 61, a movable leg portion 62 and a U-shaped portion 63. The contact member 60 has formed integrally therewith a reinforcing leg portion 64 which extends from the U-shaped portion 63 in a space between the fixed and movable leg portions. The fixed leg portion 61 has formed integrally therewith projection 61*a* and 61*b* and the movable leg portion 62 has formed therein a semicircularly bent portion 62*a* and a small projection 62*b*. The reinforcing leg portion 64 has formed therewith a small projection 64*a*. At first the projection 62*b* is made in contact with the reinforcing leg portion 64 and then can move in a resilient manner together with the reinforcing leg portion 64 untill the projection 64*a* is made in contact with the fixed leg portion 61.

Figure 9:
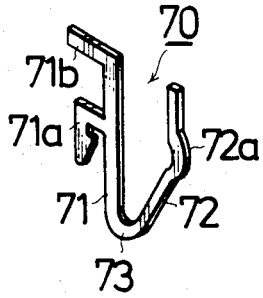
FIGS. 9, 10 and 11 are perspective view and cross sectional views of another embodiment of the contact member according to the invention.
Figure 10:
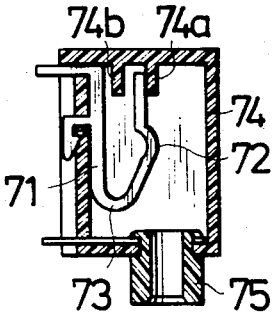
Figure 11:
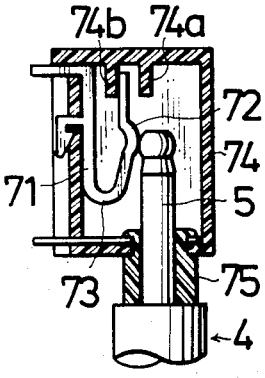

FIGS. 9, 10 and 11 show another embodiment of the contact member according to the invention. A contact member 70 of the present embodiment comprises a fixed leg portion 71, a movable leg portion 72 and a U-shaped portion 73. The movable leg portion 72 has formed therein a semicircularly bent portion 72*a* and the fixed leg portion 71 has formed therewith projections 71*a* and 71*b*. The contact member 70 is installed in a housing 74 made of electrically insulating material such as resin. The housing comprises a pair of projections 74*a* and 74*b* and a ring 75 for inserting a pin portion 5 of a pin-plug 4. When the pin portion 5 is not inserted into the jack as shown in FIG. 10, the movable leg portion 72 is urged against the projection 74*a*. When the pin portion 5 is inserted into the jack as illustrated in FIG. 11, the movable leg portion 72 is moved toward the fixed leg portion 71 until it is made in contact with the other projection 74*b*. After that the bent portion 72*a* of movable leg portion 72 can be shifted toward the leg portion 71.

Figure 12A:
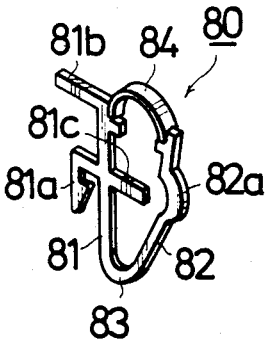
FIGS. 12A and 12B are perspective and plan views illustrating another embodiment of the contact member according to the invention.
Figure 12B:
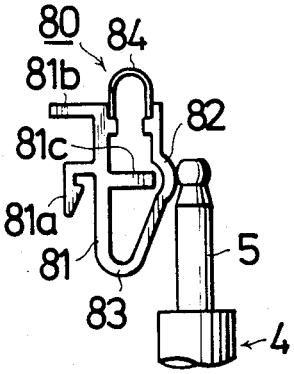

FIGS. 12A and 12B show another embodiment of the contact member according to the invention. A contact member 80 of the present invention embodiment comprises a fixed leg portion 81 with a projection 81*a*, a terminal portion and a projection 81*c*, a movable leg portion 82 with a semicircularly bent portion 82*a* and a U-shaped portion 83. Between the free ends of the fixed and movable leg portions 81 and 82 is arranged a leaf spring 84 which pushes the movable leg portion 82 apart from the fixed leg portion 81. When a pin portion 5 of a pin-plug 4 is inserted in a jack in which the contact member 80 is installed as illustrated in FIG. 12B, the movable leg portion is moved toward the fixed leg portion against the resilient force of the movable leg portion 82 and the spring 84. When the bent portion 82*a* is made in contact with the projection 81*c*, the movable leg portion 82 does not move toward the leg portion 81 any more.

Figure 13:
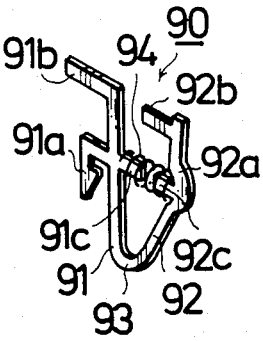
FIG. 13 is a perspective view showing still another embodiment of the contact member according to the invention.

FIG. 13 shows still another embodiment of the contact member according to the invention. A contact member 90 of the present embodiment comprises a fixed leg portion 81 with projections 91*a*, 91*b* and 91*c*, a movable leg portion 92 with a semicircularly bent portion 92*a* and projections 92*b* and 92*c*. Between the projections 91*c* and 92*c* is arranged a coiled spring 94 which makes the movable leg portion 92 apart from the fixed leg portion 91. When the pin portion of plug is inserted, the movable leg portion is moved toward the fixed leg portion 91 against the resilient force of the leg portion 92 and the spring 94 untill the projection 92*b* is made in contact with the fixed leg portion 91.

When the contact member according to the invention is installed in a housing of a jack for use in conjunction with a pin-plug and a pin portion of the pin-plug is inserted into the jack, the movable leg portion is displaced in a resilient manner toward the fixed leg portion by means of an engagement of the semicircularly bent portion of the movable leg portion with a pin portion of the pin-plug. Therefore the movable leg portion could not be displaced over a necessary amount and thus the U-shaped portion could not be deformed beyond its elastic limit. Further a contact pressure between the movable leg portion and the pin portion of the pin-plug can be maintained sufficiently high for a very long time and thus the electrical property of the pin-plug and jack connection can be improved to a great extent. Moreover since the contact member according to the invention is formed by punching a thin metal plate into a desired shape the rigidity of the U-shaped portion is very high and thus the contact pressure is further increased. Therefore the pin-plug is hardly drawn out of the jack. Further the contact member according to the invention can be easily manufactured by a single punching operation, so that any additional manufacturing step is not required.

What is claimed is:

1. A resilient contact member of an electrical jack for use in conjunction with a pin-plug and which can be manufactured by a single punching operation so that any additional manufacturing step is not required, said resilient contact member comprising:

a fixed leg portion for securing the contact member to a housing of the jack;

a movable leg portion extending substantially in parallel with the fixed leg portion;

a substantially U-shaped portion joining one end of the fixed and one end of the movable leg portions to each other;

and a reinforcing resilient leg extending in the same direction as said movable leg from said U-shaped portion into a space between the fixed and movable leg portions for engaging with the movable leg portion in a resilient manner and being movable toward the fixed leg portion, wherein said fixed and movable leg portions, U-shaped portion and reinforcing resilient leg are all formed integrally in a single manufacturing step by punching them from a thin metal plate, and wherein said reinforcing resilient leg and said movable leg extend to substantially the same end point.

2. A resilient contact member according to claim 1, wherein said resilient leg of the reinforcing member is extended from the U-shaped portion.

3. A resilient contact member according to claim 1, wherein said fixed leg portion has formed therein a lug portion for securing the contact member to the housing of the jack.

4. A resilient contact member according to claim 1 wherein said fixed leg portion has formed therein a terminal portion for connecting a lead wire to the contact member.

* * * * *